US006568529B2

(12) United States Patent
McMurrey

(10) Patent No.: US 6,568,529 B2
(45) Date of Patent: May 27, 2003

(54) NESTABLE COSMETIC PACKAGE ASSEMBLY

(76) Inventor: Stefani McMurrey, 13429 Flagstone La., Dallas, TX (US) 75240

( * ) Notice: Subject to any disclaimer, the term of this patent is extended or adjusted under 35 U.S.C. 154(b) by 0 days.

(21) Appl. No.: 09/896,779

(22) Filed: Jun. 29, 2001

(65) Prior Publication Data

US 2002/0043476 A1 Apr. 18, 2002

Related U.S. Application Data

(60) Provisional application No. 60/215,233, filed on Jun. 30, 2000.

(51) Int. Cl.[7] ..... A45D 40/02

(52) U.S. Cl. ..... 206/385; 132/317; 132/318; 206/581

(58) Field of Search ..... 206/581, 385; 132/297, 317, 318; 401/85, 86, 89

(56) References Cited

U.S. PATENT DOCUMENTS 2,131,077 A * 9/1938 Snyder ..... 132/320
2,134,570 A * 10/1938 Meilner ..... 401/50
2,414,245 A * 1/1947 Rudd ..... 132/318
3,171,416 A 3/1965 Pimentel
3,232,275 A * 2/1966 Ziegler et al. ..... 401/51
3,592,202 A 7/1971 Jones
4,915,234 A * 4/1990 Boeller ..... 132/318
5,056,179 A 10/1991 Capponi
5,069,232 A * 12/1991 Staar ..... 132/318
5,373,940 A 12/1994 Hillelson
5,620,270 A 4/1997 Gueret
5,655,554 A 8/1997 Goldberg
5,881,742 A 3/1999 Hunsberger

* cited by examiner

*Primary Examiner*—David T. Fidei
(74) *Attorney, Agent, or Firm*—Hitt Gaines & Boisbrun PC

(57) ABSTRACT

To address the deficiencies of the prior art, the present invention provides a nestable cosmetic package assembly. The nestable package assembly includes at least two cosmetic-containing portions that may be interconnected to provide a convenient, portable, and economical package for cosmetics.

18 Claims, 4 Drawing Sheets

NESTABLE COSMETIC PACKAGE ASSEMBLY

CROSS-REFERENCE TO PROVISIONAL APPLICATION

This Application claims priority from provisional application No. 60/215,233 entitled "Nesting Cosmetic Assembly," to Coy, et. al., filed on Jun. 30, 2000, which is commonly assigned with the present invention and incorporated herein by reference as if reproduced herein in its entirety.

TECHNICAL FIELD OF THE INVENTION

The present invention is directed, in general to cosmetic packaging assemblies and carrying cases. More specifically, the present invention is directed to cosmetic carrying cases having a plurality of nestable cosmetic-containing portions.

BACKGROUND OF THE INVENTION

This invention relates to the cosmetics industry in general and facial make up applicators in particular. It is well known that women carry makeup for use while traveling or attending social occasions, often as a refresher to an earlier makeup application. Women sometimes try to save time by applying makeup while driving or commuting. Conventional makeup packages are often too large, cumbersome and impractical for short trips and may not get fully used before being discarded or replaced by a new brand or color, ultimately wasting product and money. While some current cosmetic packages address size or convenience, they do not achieve interchangeable, disposable and customizable convenience, choice and size in one design component.

Nested cosmetic applicators are known in the prior art such as U.S. Pat. No. 5,881,742.

Accordingly, what is needed in the art is a convenient cosmetic package having interlocking and interchangeable applicators in an array of color or product choices. The packages which can be customized to fit the owner's needs and desires. These dispensers are preferably manufactured to be cost efficient and disposable. Although primarily intended for cosmetics, the packages have other applications, such as, tools, pens, markers, toiletries, oral hygiene products, etc.

SUMMARY OF THE INVENTION

To address the deficiencies of the prior art, the present invention provides a cosmetic package assembly including a plurality of interlocking cosmetic-containing portions.

The foregoing has outlined, rather broadly, preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

DETAILED DESCRIPTION

Figure 1A:
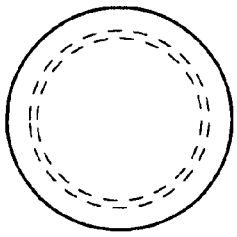
FIGS. 1A through 1C illustrate top, side and bottom views, respectively, of one embodiment of the cosmetic package assembly of the present invention.
Figure 1C:
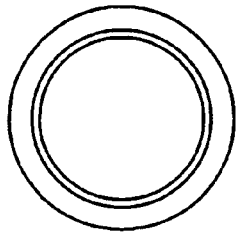
Figure 1B:
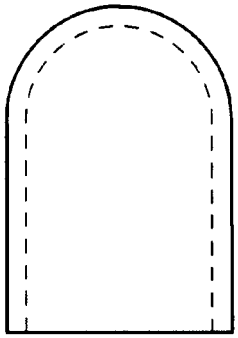
Figure 1D:
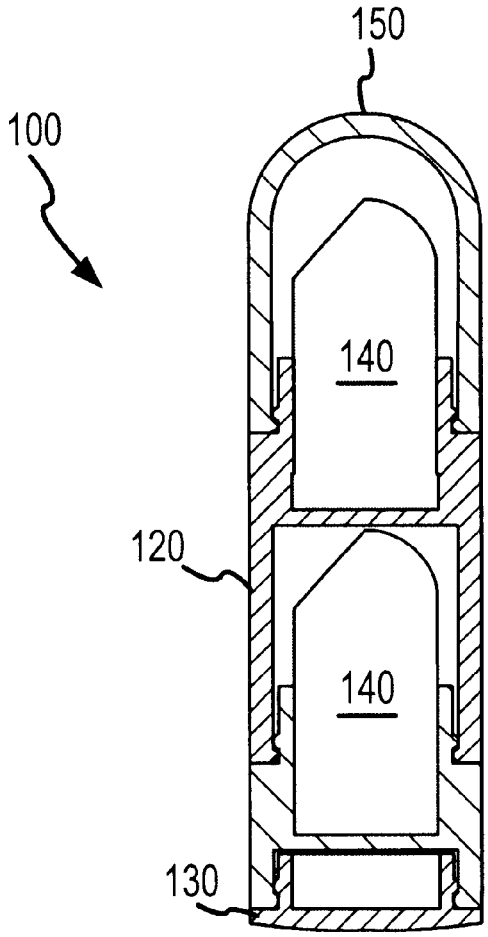
FIG. 1D illustrates a side sectional view of the nestable cosmetic packaging assembly 100 of FIGS. 1A–1C.

Turning now to FIGS. 1A–1D. FIGS. 1A through 1C illustrate top, side and bottom views, respectively, of one embodiment of a nestable cosmetic packaging assembly 100 constructed according to the present invention. FIG. 1D illustrates a side sectional view of the nestable cosmetic packaging assembly 100 of FIGS. 1A–1C. The assembly or wand is comprised of interlocking make-up applicators 120 assembled according to the individual consumer's taste. For instance, the package may contain a lipstick, lip liner, lip primer, eye liner, eye shadow and cover-up to create a six unit assembly 100. Each of the nested make-up applicators or 'bullets' 120 can be changed or replaced as needed/as desired. Therefore, some may opt for all lipsticks, while others choose to have all eye colors, or a mixture. Of course the present invention envisions embodiments with more than six units. Each assembly 100 may also be comprised of a base portion 130, a plurality of makeup portions 140 and a covered top 150.

Figure 2A:
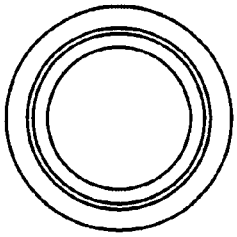
FIGS. 2A through 2C illustrate top, side and bottom views, respectively, of one embodiment of the present invention configured to receive a base portion 130.
Figure 2C:
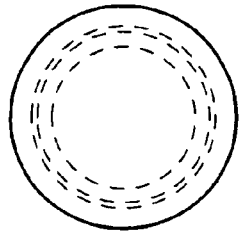
Figure 2B:
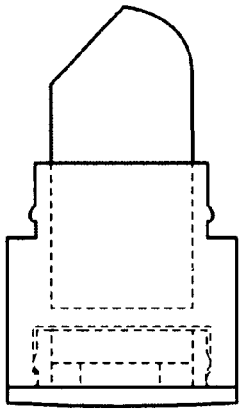
Figure 2D:
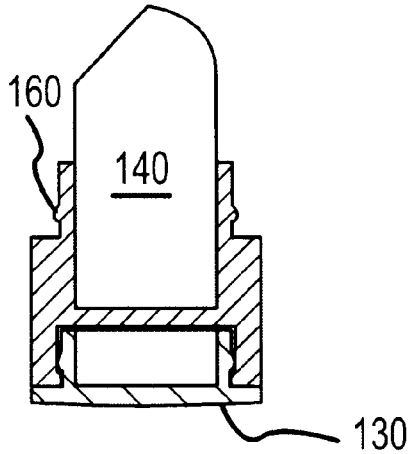
FIG. 2D illustrates a side sectional view of the present invention of FIGS. 2A–2C with the base portion 130 installed.
Figure 3A:
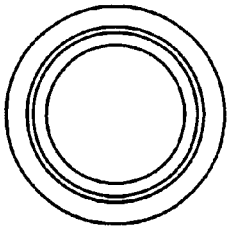
FIGS. 3A–3C illustrate top, side and bottom views, respectively, of one embodiment of nestable portions of the present invention.
Figure 3C:
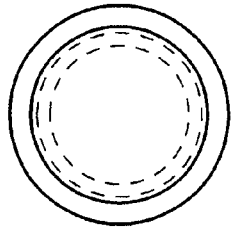
Figure 3B:
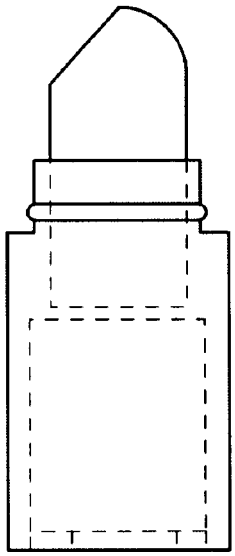
Figure 3D:
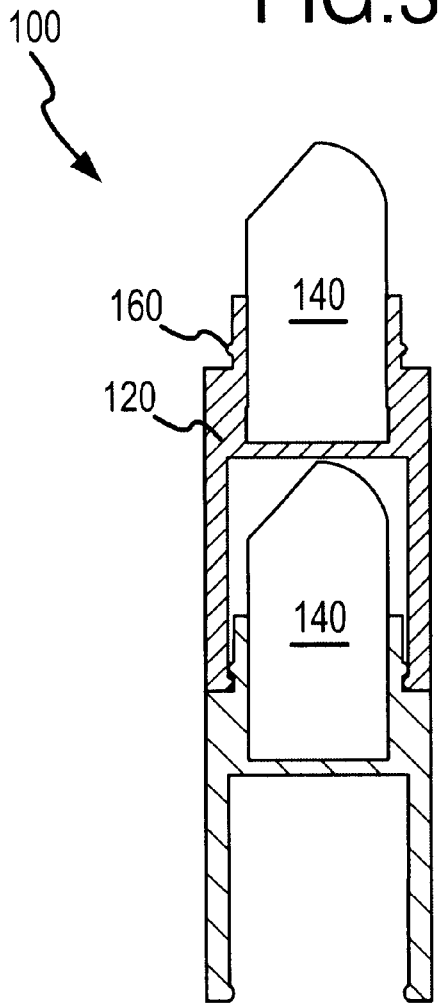
FIG. 3D illustrates a side sectional view of two nestable portions of the present invention of FIGS. 3A–3C.

Turn now to FIGS. 2A–2D and 3A–3D, with continuing reference to FIGS. 1A–1D. FIGS. 2A through 2C illustrate top, side and bottom views, respectively, of one embodiment of the present invention configured to receive a base portion 130. FIG. 2D illustrates a side sectional view of the present invention of FIGS. 2A–2C with the base portion 130 installed. FIGS. 3A–3C illustrate top, side and bottom views, respectively, of one embodiment of nestable portions of the present invention. FIG. 3D illustrates a side sectional view of two nestable portions of the present invention of FIGS. 3A–3C. Because of the nesting, it is preferred that each bullet be interchangeable as the base portion 130 or the top 150. The base portion of each bullet is shaped and sized to accommodate the makeup portion of the next lower portion making up the assembly 100. Each nested applicator 120 in the assembly 100 is interlocked to make it rigid enough to be used as a handle while using the exposed applicator, but will separate efficiently and effectively to make for convenient interchange among and between the portions.

As noted, the applicators are preferably joined by interlocking means 160 to secure portions. There are a number of approaches to achieve the interlock—ranging from a "j" hook design to a screw or snap in mechanism. Each make up portion will be housed in an individual cover that will protect the makeup while it is being reinserted or removed. Preferably, this cover will have a retracting capability to allow for optimum exposure of the product at the time of use. It may be desirable to have a brush type of applicator housed in a section for use with mascara or eye shadow.

In order to maintain a portable yet functional device, the desired assembly 100 size and shape should be about six to seven inches in length (which translates approximately to 5 or 6 one-inch 'bullet' components) and have a diameter no larger than a quarter. Materials should be lightweight and inexpensive enough to be disposable.

Figure 4:
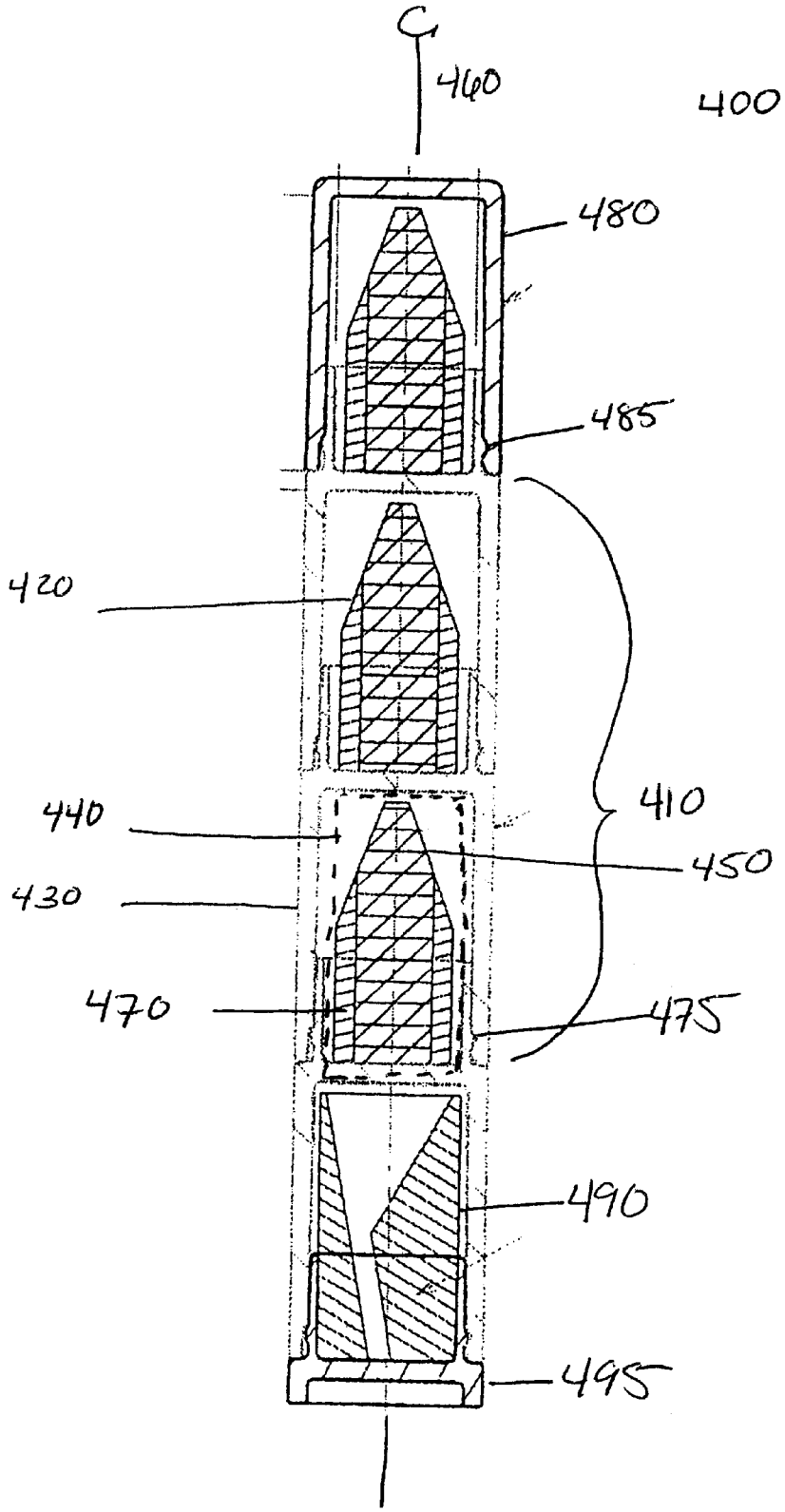
FIG. 4 schematically illustrates an embodiment of the nestable cosmetic package assembly of the present invention having a pencil-like cosmetic applicator portion.

Turning now to FIG. 4, there is illustrated a preferred embodiment of the nestable cosmetic package assembly 400 constructed according to the principles of the present invention. The assembly includes at least two cosmetic-containing portions 410 having a male end 420 and a female end 430. The male end 420 has a holder configured to retain a cosmetic pencil 440. The cosmetic pencil 440 includes a cosmetic applicator portion 450 that may be aligned along a central axis 460 of the assembly 400. The cosmetic pencil 440 may further include a rigidifying portion 470 disposed about the cosmetic applicator portion 450. The rigidifying portion 470 comprises wood, plastic or other material that may be formed about and provide rigidity to the cosmetic applicator portion 450. The cosmetic applicator portion 450 includes a cosmetic that may be any composition suitable for cosmetic purposes such as, but not limited to, eyeliner, mascara, lip liner, lipstick, lip gloss.

The female end 430 of the cosmetic-containing portion 410 is configured to receive a male end 420. The female end 430 also includes a fastening mechanism 475 that is configured to engage and retain a male end 420 of a second cosmetic-containing portion 410. The fastening mechanism 475 may comprise a snap, screw or detent mechanism. One skilled in the art may be aware of other fastening means. Such means are within the broad scope of the invention.

In another embodiment the nestable cosmetic package assembly 400 may further include a protective cap 480 that also has attachment mechanism 485 configured to secure the protective cap 480 to the male end 410. The attachment mechanism 485 may be a snap, screw or detent mechanism. In yet another embodiment the testable cosmetic package assembly 400 may further include a sharpener 490 configured to shape the cosmetic pencil 440 in a manner that facilitates the application of the cosmetic from the cosmetic applicating portion 450. In certain embodiments the sharpener 490 may be a rotary sharpener such as a conventional pencil sharpener. The sharpener 490 will also be configured to interlock, or nest, a cosmetic-containing portion 410. Another embodiment includes a base 495 configured to engage a cosmetic-containing portion 410 of the assembly 400.

Although the present invention has been described in detail, those skilled in the art should understand that they can make various changes, substitutions and alterations herein without departing from the spirit and scope of the invention in its broadest form.

What is claimed is:

1. A multi-use cosmetic package assembly, comprising:

a first nesting portion having a male end and a female end;

a second nesting portion that is a shaping device configured to:

shape at least a portion of said male end of said first nesting portion; and removably couple to said female end of said first nesting portion; and a third nesting portion having a male end and a female end, said female end of said third besting portion configured to removably couple to said male end of said first nesting portion or said second nesting portion.

2. The cosmetic package assembly as recited in claim 1 wherein said male end of said first nesting portion is a cosmetic pencil.

3. The cosmetic package assembly as recited in claim 2 wherein said cosmetic pencil comprises a central cosmetic applicator portion formed along a central axis of said cosmetic pencil and a rigidifying portion disposed about said cosmetic applicator portion.

4. The cosmetic package assembly as recited in claim 2 wherein said cosmetic pencil comprises a cosmetic selected from the group consisting of:

lipstick;

lip gloss;

lip liner;

lip primer;

eye liner;

eye shadow;

mascara, and cover-up.

5. The cosmetic package assembly as recited in claim 1 wherein said shaping device is a sharpener.

6. The cosmetic package assembly as recited in claim 1 wherein said shaping device is a rotary sharpener.

7. The cosmetic package assembly as recited in claim 1 wherein said male end of said third nesting portion is configured to removably couple to said female end of said first nesting portion, and said female end of said third nesting portion is configured to removably couple to said male end of said second nesting portion.

8. The cosmetic package assembly as recited in claim 1 further comprising a protective cover configured to removably couple to a one of said male end of the group consisting of:

said first nesting portion;

said second nesting portion; and said third nesting portion.

9. The cosmetic package assembly as recited in claim 1 wherein said female end of said first nesting portion further comprises a fastening mechanism configured to removably couple to a one of said male end of the group consisting of:

said second nesting portion; and said third nesting portion.

10. A method of packaging cosmetics, comprising:

forming a first nesting portion having a male end and a female end;

forming a second nesting portion having a male end that is a shaping device configured to:

shape at least a portion of said male end of said first nesting portion; and removably couple to said female end of said first nesting portion; and forming a third nesting portion having a male end and a female end, said female end of said third nesting portion configured to removably couple to said male end of said first nesting portion or said second nesting portion.

11. The method as recited in claim 10 wherein forming a first nesting portion includes forming a cosmetic pencil.

12. The method as recited in claim 11 wherein forming a cosmetic pencil comprises:

forming a central cosmetic applicator portion along a central axis of said cosmetic pencil; and forming a rigidifying portion about said cosmetic applicator portion.

13. The method as recited in claim 11 wherein forming a central cosmetic applicator portion comprises a cosmetic selected from the group consisting of:

lipstick;

lip gloss;

lip liner;

lip primer;

eye liner;

eye shadow;

mascara, and cover-up.

14. The method as recited in claim 10 wherein forming a second nesting portion includes forming a sharpener.

15. The method as recited in claim 10 wherein forming a second nesting portion includes forming a rotary sharpener.

16. The method as recited in claim 10 wherein said male end of said third nesting portion is configured to removably couple to said female end of said first nesting portion, and said female end of said third nesting portion is configured to removably couple to said male end of said second nesting portion.

17. The method as recited in claim 10 further comprising forming a protective cover configured to removably couple to a one of said male end of the group consisting of:

said first nesting portion;

said second nesting portion; and said third nesting portion.

18. The method as recited in claim 10 wherein forming a first nesting portion includes forming a first nesting portion further comprising forming a fastening mechanism on said female end of said first nesting portion configured to removably couple to a one of said male end of the group consisting of:

said second nesting portion; and said third nesting portion.

* * * * *

UNITED STATES PATENT AND TRADEMARK OFFICE

CERTIFICATE OF CORRECTION

PATENT NO. : 6,568,529 B1
DATED : May 17, 2003
INVENTOR(S) : Stefani McMurrey

It is certified that error appears in the above-identified patent and that said Letters Patent is hereby corrected as shown below:

Column 3,
Line 64, "besting" should be -- nesting --.

Signed and Sealed this

Fifteenth Day of July, 2003

JAMES E. ROGAN
*Director of the United States Patent and Trademark Office*